US006076358A

United States Patent [19]

Bin-Nun

[11] Patent Number: 6,076,358

[45] Date of Patent: Jun. 20, 2000

[54] CRYOCOOLER REGENERATOR ASSEMBLY WITH MULTIFACETED COLDWELL WALL

[75] Inventor: Uri Bin-Nun, Keene, N.H.

[73] Assignee: Inframetrics Inc., North Billerica, Mass.

[21] Appl. No.: 09/177,278

[22] Filed: Oct. 22, 1998

[51] Int. Cl.[7] ..... F25B 9/00

[52] U.S. Cl. ..... 62/6

[58] Field of Search ..... 62/6; 60/520; 165/4, 165/10

[56] References Cited

U.S. PATENT DOCUMENTS 4,858,442 8/1989 Stetson ..... 62/6

*Primary Examiner*—Henry Bennett
*Assistant Examiner*—Malik N. Drake
*Attorney, Agent, or Firm*—Edward L. Kelley

[57] ABSTRACT

An improved integral cryogenic refrigerator, or cryocooler, for cooling an electronic device to cryogenic temperature includes a regenerator sleeve having a cylindrical base portion and an integrally formed cold well tube. The cold well tube includes a thin outer wall and a longitudinal bore passing therethrough for providing an expansion cylinder for receiving a pressurized refrigeration gas therein. An outer surface of the thin outer wall of the cold well tube has an outer diameter substantially centered with respect to the longitudinal bore thereby providing a circular cross-section to the thin outer wall. At least one facet is formed onto the outer diameter by removing material from the outer diameter to reduce the thickness of the thin outer wall in the region of the facet thereby reducing the cross-sectional area of the outer wall. The facet may extend substantially over the full length of the cold well tube, however, a circular cross-sectional mounting area is beneficially provided one end for receiving the cold well end cap thereon.

23 Claims, 4 Drawing Sheets

CRYOCOOLER REGENERATOR ASSEMBLY WITH MULTIFACETED COLDWELL WALL

RELATED APPLICATIONS

This application is related to commonly assigned application Ser. No. 09/177,228, filed even dated herewith, entitled INTEGRATED CRYOCOOLER ASSEMBLY WITH IMPROVED COMPRESSOR PERFORMANCE.

FIELD OF THE INVENTION

This invention relates generally to the field of cryogenic coolers, and particularly to improving the efficiency of a miniature integral Stirling cryocooler.

BACKGROUND OF THE INVENTION

The need for cooling electronic devices such as infrared detectors to cryogenic temperatures is often met by miniature refrigerators operating on the Stirling cycle principle. As is well known, these cryogenic refrigerators or cryocoolers, use a motor driven compressor to impart a cyclical volume variation to a working volume filled with pressurized refrigeration gas. The pressurized refrigeration gas is forced through the working volume to one end of a sealed cylinder called a cold well. A piston-shaped heat exchanger or regenerator is positioned inside the cold well. The regenerator has openings at each end to allow the refrigeration gas to enter and exit the cold well through the regenerator.

The regenerator reciprocates at a 90° phase shift relative to the compressor piston and the refrigeration gas is force to flow through the cold well in alternating directions. The refrigeration gas is thereby forced to flow from the compressor, or warm end, through the regenerator piston and into the cold end of the sealed cold well and then back. As the regenerator reciprocates, the warm end of the cold well which directly receives the refrigeration gas from the compressor becomes much warmer than the ambient. In the opposite end of the cold well, called the expansion space or cold end, the refrigeration gas becomes much colder than the ambient. A device to be cooled is thus mounted adjacent to the expansion space, or cold end of the cold well such that thermal energy from the device to be cooled is passed to the refrigeration gas through a wall of the cold well.

It is a typical problem in the design of cryocooler systems to reduce the heat load of the cold well so that increased cooling power is achieved. The heat load is defined by the amount of thermal energy which must be removed from the cold well cold end in order to maintain the device to be cooled at the required operating temperature. Alternately, the cooling power is defined as the amount of thermal power removed by the refrigeration gas in order to maintain the device to be cooled at the desired temperature. Heat load is typically reduced by proper selection of the cold well materials, by proper structural design and by selection of surface finishes. The heat load of a system can be determined by use of a boil-off test, conducted at room temperature, whereby a cold well is filled with liquid nitrogen, or the like, and the time required to evaporate the liquid nitrogen is measured.

It is known to reduce convective heat load by providing a housing or dewar surrounding the cold well and by evacuating the dewar to very low vacuum pressures, e.g. as low as $5\times10^{-9}$ torr, thereby surrounding the cold well with a vacuum space. Thus room temperature air surrounding the dewar is prevented from warming the cold well.

It is also known to reduce radiative heat load of the cold well by coating the external surfaces of the cold well as well as the internal surface of the dewar surrounding the cold well with a highly thermally reflective surface finish, e.g. gold, silver or the like.

The more difficult problem of reducing the heat load of the cold well has heretofore been the problem of reducing conductive heat load passing through the walls of the cold well itself. Thermal energy conducted from the compressor end of the cold well toward the cold end of the cold well may account for as much as 70% of the total heat load. Temperature gradients between the compressor end and the cold end may reach as much as 270° C.

It is known to reduce the cross sectional area of the cold well walls to reduce the conductive heat load. Thin walled cold wells with cylindrical cross-section have been used in the prior art to minimize cross-sectional area. Uniform thickness cold well walls of approximately 0.005 inches are used in the prior art, however, use of even thinner walls reduces the structural integrity of the cold well which could rupture due internal pressures or could cause cyclic movement of the cold end as the working volume of the expansion space varies with each regenerator cycle. Such movement of the cold end is undesirable in optical systems since the lateral or bending motion causes an effective increase in the blur spot thereby reducing system resolution (MTF) and pointing accuracy.

It is also known to use a cold well with a cylindrical cross-section but having a non-uniform wall thickness, e.g. tapering from a first wall thickness at the compressor end to thinner wall thickness at the cold end, to thereby increase thermal resistance near the cold end. This method reduces heat load but requires additional structural elements to maintain the structural integrity of the cold well. The tapered wall cold well is also difficult and expensive to manufacture due to the increased complexity of forming a tapered element, especially a thin walled tapered element.

It is therefore a general problem in the art to improve the performance of cryocooling systems while maintaining substantially similar or a decreased manufacturing cost.

It is a further problem in the art to reduce the heat load of cryocooler systems.

It is a specific problem in the art to reduce the conductive heat load of a cold well while maintaining sufficient structural integrity of the cold well walls for normal operation.

SUMMARY OF THE INVENTION

It is therefore a general object of the present invention to improve the performance of a cryocooler system without substantially increasing manufacturing costs. It is a further object of the present invention to provide a cold well with a reduced heat load. It is a still further object of the present invention to provide a cold well with reduced conductive heat load without significantly decreasing the structural integrity of the cold well.

The present invention, detailed below, provides a regenerator sleeve for an integrated cryocooler. The regenerator sleeve comprises a substantially cylindrical base portion for connecting the regenerator sleeve to a cryocooler crankcase which houses a compressor and a compressor drive device which also drives a regenerator piston within the cylindrical base portion. A cold well tube is attached to the cylindrical base portion and includes an upper end adjacent the base portion and cold end opposite to the upper end. The cold well tube includes a thin outer wall and a longitudinal bore which passes through its full length thereby providing an expansion cylinder for receiving a pressurized refrigeration gas therein and for providing an expansion space for the pressurized refrigeration gas to expand at the cold end of the cold well tube. A cold well end cap, which includes a surface onto which an element to be cooled is mounted, is welded onto the cold end of the cold well tube to seal the expansion space. An outer surface of the thin outer wall of the cold well tube has an outer diameter substantially centered with respect to the longitudinal bore thereby providing a circular cross-section to the thin outer wall. At least one facet is formed onto the outer diameter by removing material from the outer diameter to reduce the thickness of the thin outer wall in the region of the facet thereby reducing the cross-sectional area of the outer wall. The facet may extend substantially from the upper end to the cold end, however, a circular cross-sectional mounting area is beneficially provided at the cold end of the cold well tube for receiving the cold well end cap thereon.

Moreover the cross-sectional area of the cold well tube may be further reduced by providing a plurality of facets, each subtending an equal angle with respect to a longitudinal axis of the cold well tube such that each facet meets two adjacent facets at apexes formed therebetween and such that flat facets may extend substantially from the upper end of the cold well tube to the cold end.

The cold well tube may also house a hollow regenerator tube formed of epoxy and fiberglass within the longitudinal bore. The regenerator tube may also include a plurality meshed metallic heat exchange elements contained within the hollow portion. The heat exchange elements allow the pressurized refrigeration gas to pass through them in alternating directions to remove thermal energy from the pressurized refrigeration gas.

There is also disclosed a method for cooling an element comprising the steps of providing a regenerator sleeve having a cylindrical base portion connected to a cryocooler crankcase and a cold well tube integrally formed with the cylindrical base portion such that the cold well tube includes a longitudinal bore for providing an expansion cylinder therein. A movable regenerator piston is provided at least partially within the cylindrical base which cyclically varies the working volume of the expansion space. A pressurized refrigeration gas received from the crankcase passes through the expansion cylinder in alternating directions and is expanded at the cold end of the longitudinal bore. The expansion cylinder may also include a heat exchange element. The method further includes the steps of providing the cold well tube with a thin outer wall having an outer diameter substantially centered with respect to the longitudinal bore and including at least one facet to reduce the thickness of the thin outer wall in the region of the facet thereby reducing the cross-sectional area of the outer wall. Further steps include sealing the expansion cylinder with a cold well base element welded to the cold well at the cold end.

BRIEF DESCRIPTION OF THE DRAWINGS

The present invention may best be pointed out with particularity in the appended claims. The above and further advantages of the present invention may be better understood by referring to the following description in conjunction with the accompanying drawings in which:

DETAILED DESCRIPTION OF THE INVENTION

Figure 1:
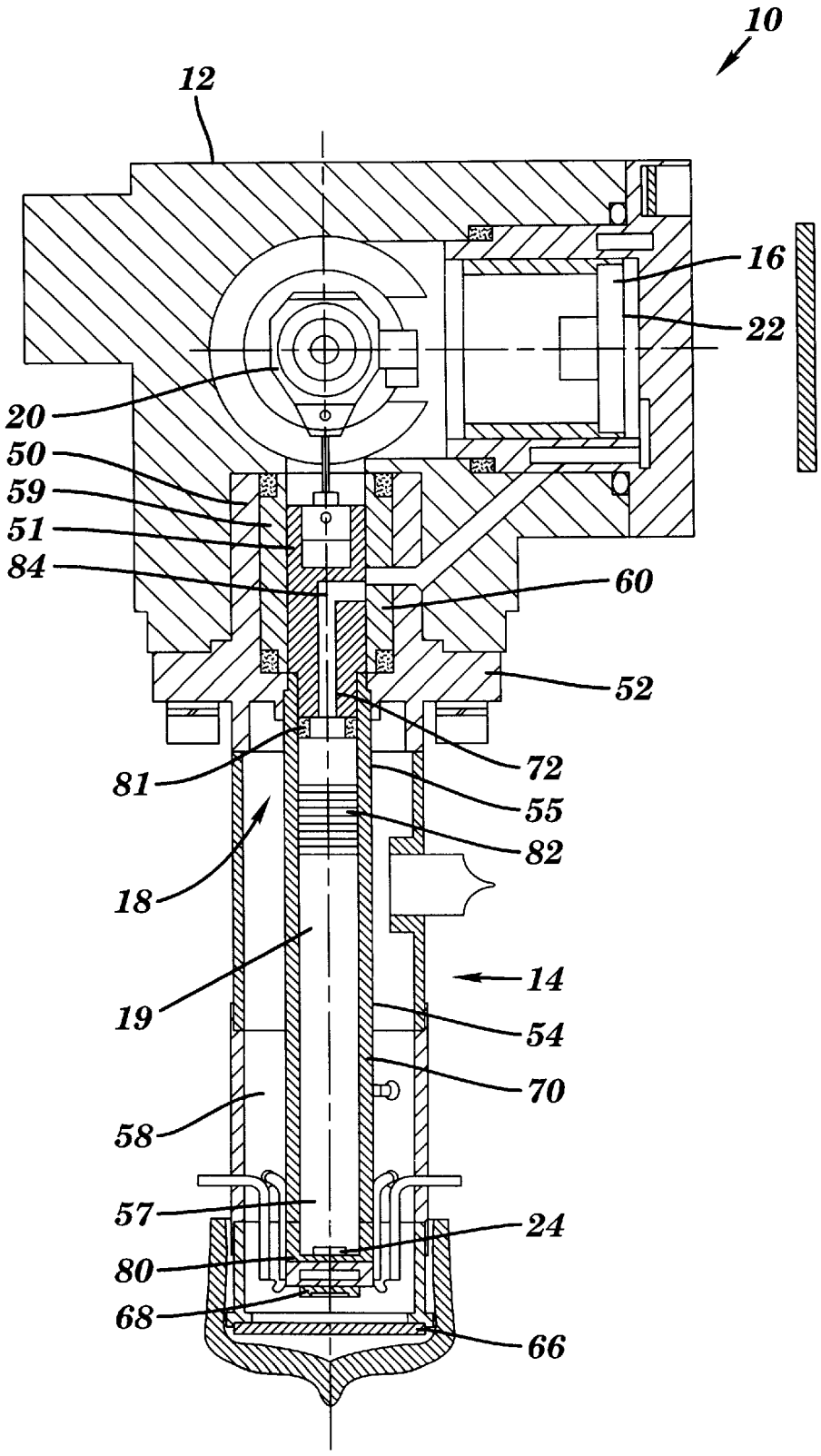
FIG. 1 depicts a sectional view of an integral cryocooler according to the present invention.

Referring now to FIG. 1 there is shown a sectional view of an integral cryocooler referred to generally as reference numeral 10, according to the present invention. The cryocooler 10 includes a crankcase 12, a dewar assembly, generally referred to as reference numeral 14, a hollow compression piston assembly 16, which is movable within a cylinder of the crankcase 12, a regenerator assembly, generally referred to as reference numeral 18, which includes a movable regenerator piston 72, and a drive coupler 20 for driving the compression piston 16 and the regenerator piston 72, simultaneously.

Cryocooler 10 is of the type referred to as a two piston V-form integral Stirling cryocooler. Such a cryocooler is disclosed in commonly assigned U.S. Pat No. 4,858,442, incorporated herein by reference.

Figure 2:
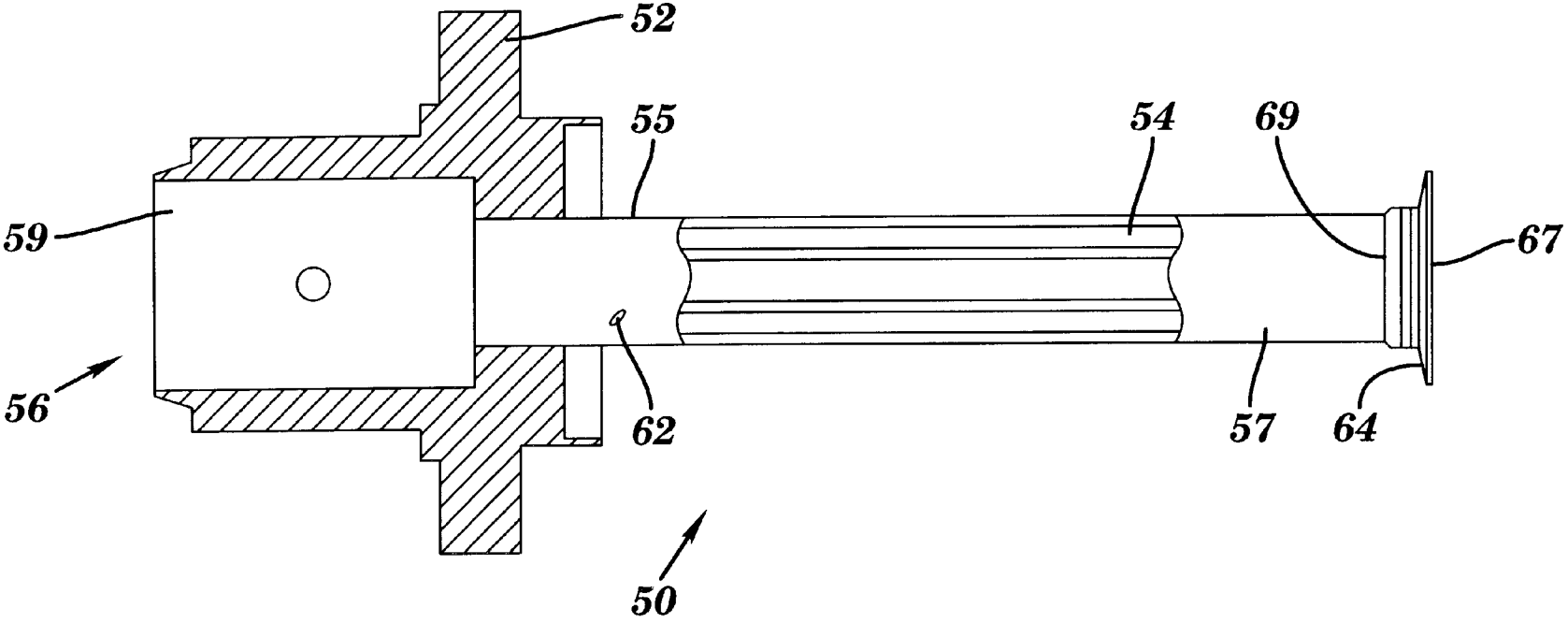
FIG. 2 depicts a cold well a tube assembly.

Specifically an expansion cylinder 19 is defined by a regenerator sleeve 50, having a cylindrical base portion 52 and a cold well tube 54 formed integrally with the cylindrical base portion 52 as shown in FIG. 2 or which may be formed as a separate element and attached to the cylindrical base portion 52 by welding, bonding or other mechanical attachment methods. The cold well tube 54 comprises a thin walled tube having a longitudinal bore having an inner diameter $d_i$ which passes through its entire length and an outer surface which is detailed below. Cold well tube 54 includes an upper end 55 adjacent and attached to the cylindrical base portion 52 and an expansion end or cold end 57 opposite from the upper end 55. A longitudinal bore 56 passes through the regenerator sleeve 50 having a first diameter 59 for receiving a regenerator cylinder sleeve 60 therein. The regenerator sleeve 60 includes a smaller bore 51 for receiving a regenerator piston 72 for movement therein. A regenerator tube 70 is formed of epoxy and fiberglass, and engages with a portion of the regenerator piston 72 at its upper end and is housed within the cold well tube 54. In the upper end of the regenerator tube 70 is an upper regenerator retainer 81 and in its lower end, a lower regenerator retainer 80. Retainers 80 and 81 retain a stack of disk shaped flow through metallic heat exchanging element 82 in place while allowing refrigeration gas to enter and exit the regenerator assembly 18 while passing through the stack of flow through heat exchange elements 82. It is the alternate cooling and heating of the heat exchanging elements 82 which allows the expansion space 24, located at the cold end 57, to become extremely cold. An appropriate opening 84 is formed in the regenerator piston 72 to allow pressurized gas from compression space 22 to communicate with the heat exchanging elements 82 inside of the regenerator tube 70 thus allowing alternating flow of the refrigeration gas between the compression space 22 and the cold end 57.

A cold well end cap 64 is welded to the cold end 57 of the cold well tube 54 thereby sealing the cold end of the cold well tube 54. The cold well end cap 64 is preferably formed from a low thermal resistance material and includes a mounting surface 67 onto which an element to be cooled 68, e.g. an infrared detector or the like, is mounted.

A cylindrical dewar assembly 14 surrounds the cold well tube 54 providing an insulating space 58. The dewar assembly 14 is vacuum sealed with regenerator sleeve 50 at the cylindrical base portion 52. A high vacuum is pumped in the insulating space 58 to reduce convective heat gain of the cold well tube 54. External walls of the cold well tube 54 as well as external walls of the dewar assembly 14 are coated for high reflectivity of thermal energy, (low emmissivity), e.g. using gold or silver electroplating or the like, to reduce the radiative heat load of the cold well tube 54. The dewar assembly 14 includes a transparent window 66 for allowing energy from a scene to be viewed to reach the infrared detector 68.

Referring now to the conductive heat load of the cold well tube 54, the conductive heat load Q is given according to Fourie's law of heat conduction as follows:

$$Q=kA(T2-T1)/L \quad (1)$$

where:

Q=heat load of the cold well tube 54, in BTU/hour;

k=thermal conductivity of the cold well tube material, in BTU/hour-inch-degree F;

T2, T1=are the temperatures, in degrees F, of the cold well upper end 55 and the cold well tube cold end 57 respectively;

L length of the cold well tube 54, in inches; and,

A=cross sectional area of the cold well tube 54, in square inches.

In the case of a cold well tube which has a circular cross section, specifically, cold well tube 54 depicted as in FIG. 2 as has been used in the prior art, it has an inner diameter $d_i$ of 0.240 inches and an outer diameter $d_o$ of 0.250 inches. The cross sectional area of the tube 54 is given by;

$$A=\pi(d_o^2-d_i^2)/4=3.848\times10^{-3}\ \text{in}^2 \quad (2)$$

Figure 4:
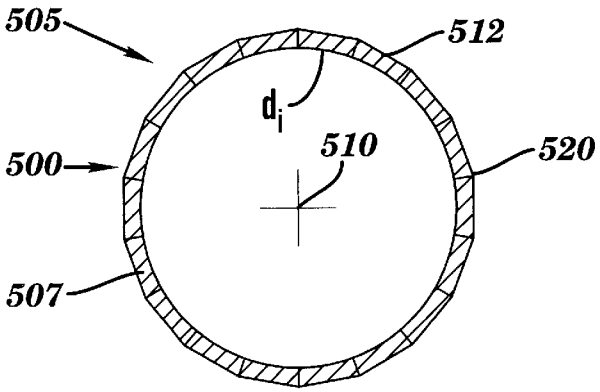
FIG. 4 depicts a sectional view of a multifaceted cold well according to the present invention.

FIG. 4 depicts a multifaceted cold well tube 500 according to the present invention. Cold well tube 500 has a cross-section having an inner diameter $d_i$ of 0.240 inches, which is equal to that of the prior art cold well tube 54, and a multifaceted outer wall 505 which in the preferred embodiment includes 18 facets 507. Each facet 507 subtends an angle a with respect to a longitudinal axis 510 of the cold well tube 500. Longitudinal axis 510 is centered with respect to inside diameter $d_i$. In the case of 18 facets, the angle a subtends 20 degrees. Each facet 507 includes a flat outer surface 512 which meets with two other flat outer surfaces 512 of adjacent facets 507 at apexes 520.

Figure 5:
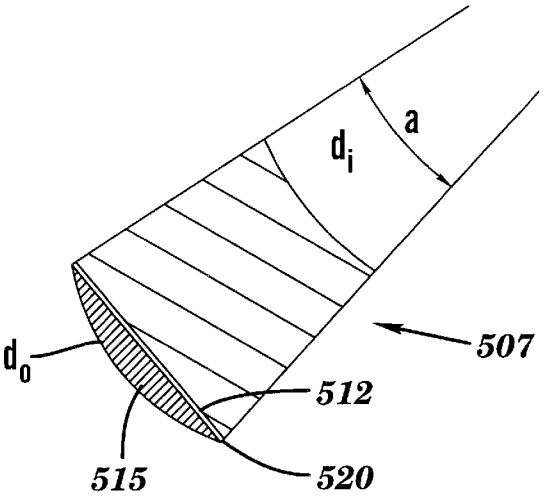
FIG. 5 depicted an exploded sectional view of a single facet according to the present invention.

A single facet 507 is shown in exploded cross section in FIG. 5. A shaded area 515 depicts a cross-section of material removed to form each facet 507. The multifaceted cold well tube 500, may be fabricated by first forming a circular cross sectional cold well tube, as in tube 54, and then by removing material to form each facet 507 such that each facet extends substantially over the full longitudinal length of the cold well tube 54 from upper end 55 to lower end 57 except that a mounting area 69 at the cold end 57 is maintained as a circular cross-section for ease of assembly with the cold well end cap 64. In removing the material to form the facets 507, a plurality of apexes 520 are formed at the points where adjacent facets intersect. Preferably, a diameter which just encloses the plurality of apexes 520 would be substantially equal to the diameter do of the prior art cold well tube 54, since no material would be removed at the apexes 520. Thus the tube 500, of the present invention, has an inner diameter $d_i$ substantially equal to 0.240 inches and is substantially inscribed within an outer diameter which is substantially equal to do or 0.250 inches. The cross sectional area of the cold well tube 500 is therefore reduced by an amount equal to the cross-sectional area of material removed to form each of the 18 facets, area 515 shown shaded in FIG. 5.

Figure 6:
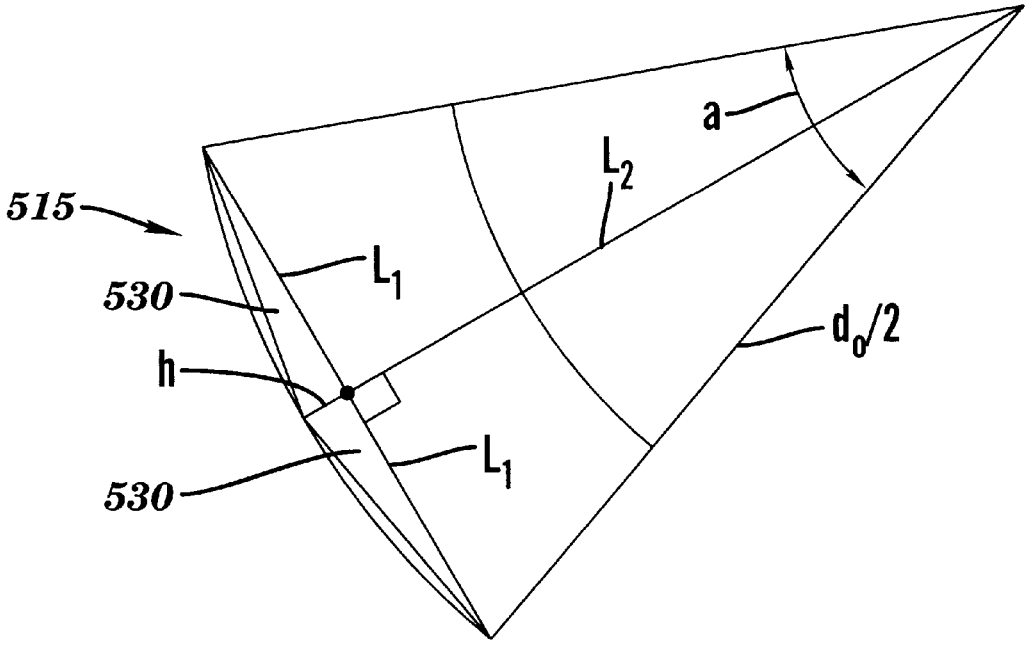
FIG. 6 depicts a schematic representation of the cross-sectional area of the material removed to form a single facet according to the present invention.

Area 515 can be approximated by determining the area of the two triangles 530 depicted in exploded view of FIG. 6. Each triangle 530 has a base length $L_1$ and a height h. Using the triangle having sides $L_1$, $L_2$ and $d_0/2$, the base length $L_1$ is given by:

$$L_1=(d_0 2 \sin(a/2))=0.0217\ \text{in} \quad (3)$$

The length $L_2$ is given by:

$$L_2=(d_0/2 \cos(a/2))=0.1231\ \text{inc.}; \quad (4)$$

the height h at the apex of triangle 530 is given by;

$$h=d_0/2-L_2=0.0019\ \text{in.; and,} \quad (5)$$

the area $A_r$ of the triangle 530 is given by;

$$A_r=\tfrac{1}{2}\,L_1{*}h=2.062\times10^{-5}\ \text{in}^2 \quad (6)$$

The area $2A_r$, approximates area 515 removed to form each facet so that the total cross sectional area of the cold well tube 500 is reduced by $36A_r$ or $7.421\times10^{-4}$ in$^2$.

In comparing the circular cross-sectional cold well tubes 54 with the multi-faceted cold well tube 500 of the present invention, the cross-sectional area of cold well tube 500 is $3.106\times10^{-4}$ in$^2$ or approximately 19% less than the cross-sectional area of the circular cold well tube 54. In accordance with Fourie's law of heat conduction, given by equation 1 above, the conductive heat load Q of cold well tube 500 is directly reduced by 19% over the cold well tube 54.

Another aspect of the present invention is that each of the facet outer surfaces 512 are polished to a bright shiny finish having less than a 4 micro inch average surface roughness. This polishing further reduces radiative heat load by improving the reflectivity of the outer surfaces 512. The regenerator sleeve 50 may be fabricated from a suitable metal e.g. carbon steel, stainless steel, aluminum or titanium and is suitably formed as an integral unit in order to ease its manufacture and to maximize stiffness and mechanical integrity.

Figure 3:
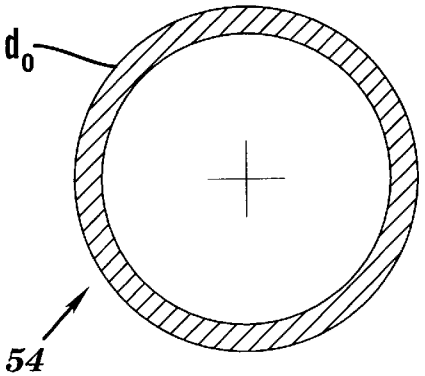
FIG. 3 PRIOR ART
FIG. 3 depicts a sectional view of a cold well having a circular cross-section as might be used in the prior art.

In order to compare the performance of the circular cross-sectional cold well tube 54 of the prior art with the multi-faceted cold well tube 500 of the present invention, a plurality of boil-off tests were conducted between substantially identical cryocooler assemblies 10 employing circular cross-sectional and multi-faceted cold well tubes. Regenerator sleeve assemblies 18 were installed into cryocooler assemblies 10 as shown in FIG. 1 and filled with liquid nitrogen having a temperature of approximately 77 degrees K. The cryocooler assemblies 10 were maintained at room temperature for the boil-off test. The average time for the liquid nitrogen to evaporate was measured for the two types of cold well tubes with a result that the boil-off time for the circular cross-sectional cold well tube 54, shown in FIG. 3, averaged 26.5 minutes and the boil-off time for multi-faceted cold well tube 500 of the present invention, shown in FIG. 4, averaged 21.0 minutes. The average boil-off time of the cryocooler assemblies 10 of the present invention improved by more than 20%.

It will be appreciated by one skilled in the art, that any number of facets may be used to reduce the cross sectional area of a cold well tube 500 and further that the facet shape and length may be changed to maintain sufficient wall thickness as required by the particular application. In the example given above wherein $d_i$=0.240 inches and $d_o$=0.250 inches, the wall thickness of the circular cross-sectional tube 500 was reduced from 0.005 inches to 0.0031 inches at the center of each facet when 18 facets were employed. It will be apparent from the above equations that for the example given the use of fewer than 18 facets will cause the wall of the cylinder to be completely removed if the facets are cut to the full depth as shown in the present invention. Thus the use of fewer than 18 facets in the present example is not practical without decreasing the facet height given by h in equation 5 above. Conversely, more than 18 facets could be employed for the geometry of the present example, however, the reduction in cross-sectional area decreases as the number facets is increased.

Thus for a thin walled cold well tube 500 having a given internal diameter $d_i$ there exists a minimum number of equal size flat facets 507 of a given height h which maximizes the reduction in cross-sectional area of the cold well tube 500. This minimum number of facets is selected such that sufficient wall thickness remains at the center of each facet to maintain a desired stiffness of the cold well tube. Use of more than the minimum number of facets provides less reduction in cross-sectional area of the cold well tube.

It will also be recognized by those skilled in the art that, while the invention has been described above in terms of preferred embodiments, it is not limited thereto. Various features and aspects of the above described invention may be used individually or jointly. For example, other methods of reducing the cross-sectional area of the cold well tube such as a cutting grooves or non-uniformly spaced facets in the outside diameter of the cold well lube may also be employed without deviating from the spirit of the present invention. Further, although the invention has been described in the context of its implementation in a particular environment, and for particular applications, e.g. an integrated cryocooler assembly, those skilled in the art will recognize that its usefulness is not limited thereto and that the present invention can be beneficially utilized in any number of environments and implementations. Accordingly, the claims set forth below should be construed in view of the full breadth and spirit of the invention as disclosed herein.

What I claim and desire to secure by Letters of Patent of the United States are the following:

1. A regenerator sleeve for forming a cryocooler expansion space comprising:

(a) a cylindrical base portion for connecting to a cryocooler crankcase and formed to receive a regenerator piston assembly therein; and (b) a cold well tube having by a thin outer wall and having a longitudinal bore of an inner diameter passing therethrough, an upper end for connecting to the cylindrical base portion, a cold end opposite the upper end for providing the expansion space within the longitudinal bore at the cold end and wherein the thin outer wall includes an outer surface substantially having an outer diameter centered with respect to the longitudinal bore and further comprising at least one facet formed thereon for reducing the thickness of the thin outer wall in the region of the facet.

2. A regenerator sleeve according to claim 1 further comprising a cold well end cap connected to the cold well tube at the cold end for sealing the cold well tube.

3. A regenerator sleeve according to claim 2 wherein the cold well tube adjacent to the cold end further comprises a mounting area having a circular cross-section for receiving the cold well end cap thereon.

4. A regenerator sleeve according to claim 3 wherein the at least one facet comprises a plurality of facets and wherein each of the plurality of facets subtends an equal angle with respect to a longitudinal axis of the cold well tube and further wherein each of the plurality of facets meets two adjacent facets at apexes formed therebetween and wherein each of the plurality of facets extends along the outer surface substantially from the upper end to the mounting area.

5. A regenerator sleeve according to claim 4 wherein said equal angle is substantially 20 degrees.

6. A regenerator sleeve according to claim 1 wherein the at least one facet extends along the outer surface substantially from the upper end to the cold end.

7. A regenerator sleeve according to claim 1 wherein the at least one facet comprises a plurality of facets.

8. A regenerator sleeve according to claim 7 wherein each of the plurality of facets extends along the outer surface substantially from the upper end to the cold end.

9. A regenerator sleeve according to claim 7 wherein each of the plurality of facets subtends an equal angle with respect to a longitudinal axis of the cold well tube and further wherein each of the plurality of facets meets two adjacent facets at apexes formed therebetween.

10. A regenerator sleeve according to claim 9 wherein each of the plurality of facets extends along the outer surface substantially from the upper end to the cold end.

11. A regenerator sleeve according to claim 1 further comprising at least one meshed heat exchange element housed within the cold well tube longitudinal bore for allowing the pressurized refrigeration gas to pass therethrough in alternating directions thereby removing thermal energy from the pressurized refrigeration gas.

12. A regenerator sleeve according to claim 11 further comprising:

(a) a regenerator sleeve housed within the cylindrical base portion;

(b) a regenerator piston movable within the regenerator sleeve for changing the volume of a pressurized refrigeration gas contained within the cold well tube longitudinal bore; and, (c) a regenerator tube housed within the cold well tube longitudinal bore for containing the at least one meshed heat exchange element.

13. A regenerator sleeve according to claim 1 where the cylindrical base portion and the cold well tube are integrally formed.

14. A regenerator sleeve according to claim 13 wherein the regenerator assembly comprises titanium.

15. A method for cooling an element to be cooled comprising the steps of:

(a) providing a regenerator assembly having a cylindrical base portion for connecting to a cryocooler crankcase and forming the cylindrical base portion to receive a regenerator piston assembly therein;

(b) providing a cold well tube having by a thin outer wall having a longitudinal bore of an inner diameter passing therethrough, an upper end for connecting to the cylindrical base portion, a cold end opposite the upper end for providing an expansion space within the longitudinal bore at the cold end and wherein the thin outer wall includes an outer surface substantially having an outer diameter centered with respect to the longitudinal bore;

(c) sealing the expansion space with a cold well end cap connected to the cold well at the cold end;

(d) reciprocating a regenerator piston within the regenerator piston assembly thereby cyclically varying the volume of a pressurized refrigeration gas received from the crankcase and contained within the cold well tube longitudinal bore and for allowing the pressurized refrigeration gas to pass through the longitudinal bore in alternating directions thereby removing thermal energy from the pressurized refrigeration gas; and, (e) providing at least one facet formed on the cold well tube outer surface for reducing the thickness of the thin outer wall in the region of the facet.

16. A method according to claim 15, further comprising the step of, forming a plurality of facets on the cold well tube outer surface for reducing the thickness of the thin outer wall in the region of each of the plurality facets.

17. A method according to claim 15, further comprising the step of, providing at least one meshed heat exchange element housed within the longitudinal bore for allowing the pressurized refrigeration gas to pass therethrough in alternating directions thereby removing thermal energy from the pressurized refrigeration gas.

18. A method according to claim 16 wherein each of the plurality of facets extends along the outer surface substantially from the upper end to the cold end.

19. An integrated cryocooler assembly comprising:

(a) a reciprocating compression piston housed within a crankcase for compressing a refrigeration gas in a compression space;

(b) a reciprocating regenerator piston for changing the volume of the pressurized refrigeration gas in an expansion space;

(c) a drive motor and a drive coupling for driving the compressor and the regenerator piston 90 degrees out of phase with each other;

(d) a passage formed between the compression space and the expansion space for allowing the refrigeration gas to pass in alternating directions between the compression space and the expansion space;

(e) a regenerator sleeve comprising a cylindrical base portion for connecting to the crankcase and formed to receive at least a portion of the regenerator piston therein, the regenerator sleeve further comprising a cold well tube having by a thin outer wall having a longitudinal bore of an inner diameter passing therethrough, the cold well tube having an upper end for connecting to the cylindrical base portion, a cold end opposite the upper end for providing the expansion space within the longitudinal bore at the cold end and wherein the thin outer wall includes an outer surface substantially having an outer diameter centered with respect to the longitudinal bore and further comprising at least one facet formed thereon for reducing the thickness of the thin outer wall in the region of the facet.

20. An integrated cryocooler assembly according to claim 19 further comprising a cold well end cap connected to the cold well tube at the cold end for sealing the cold well tube.

21. A regenerator sleeve according to claim 20 wherein the cold well tube adjacent to the cold end further comprises a mounting area having a circular cross-section for receiving the cold well end cap thereon.

22. A regenerator sleeve according to claim 21 wherein the at least one facet comprises a plurality of facets and wherein each of the plurality of facets subtends an equal angle with respect to a longitudinal axis of the cold well tube and further wherein each of the plurality of facets meets two adjacent facets at apexes formed therebetween and wherein each of the plurality of facets extends along the outer surface substantially from the upper end to the mounting area.

23. A regenerator sleeve according to claim 22 wherein said equal angle is substantially 20 degrees.

* * * * *